US008695935B1

(12) United States Patent
Kasbohm

(10) Patent No.: US 8,695,935 B1
(45) **Date of Patent: *Apr. 15, 2014**

(54) COMPACT PORTABLE FIREARM HOLDING DEVICE

(71) Applicant: Michael Kasbohm, Eden Prairie, MN (US)

(72) Inventor: Michael Kasbohm, Eden Prairie, MN (US)

(73) Assignee: SpecTech, Inc., Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/789,913

(22) Filed: Mar. 8, 2013

Related U.S. Application Data

(63) Continuation of application No. 12/267,714, filed on Nov. 10, 2008, now Pat. No. 8,403,278.

(51) Int. Cl.
*A47G 1/17* (2006.01)

(52) U.S. Cl.
USPC ..... 248/206.5; 248/309.4; 248/683; 248/551; 211/64; 224/562; 42/99

(58) Field of Classification Search
USPC ..... 248/206.5, 309.4, 683, 205.5, 309.3, 248/551; 211/64; 224/562, 570; 42/99
See application file for complete search history.

(56) References Cited

U.S. PATENT DOCUMENTS 1,837,939 A * 12/1931 Zimmerman ..... 224/42.33
2,348,902 A 5/1944 Hart
2,958,422 A 11/1960 Caloiero et al.
3,706,403 A 12/1972 Sikes
3,746,177 A * 7/1973 Vilotti ..... 211/64
4,230,296 A 10/1980 Staley et al.
4,461,385 A 7/1984 Clouser
4,579,263 A 4/1986 Ehmke et al.
4,796,762 A 1/1989 Law
D302,628 S 8/1989 Smith
4,852,780 A 8/1989 Woodbury
4,985,817 A * 1/1991 Yale ..... 362/396
4,986,427 A 1/1991 Law et al.
5,360,190 A * 11/1994 Walker et al. ..... 248/201
5,443,191 A * 8/1995 Jorgenson ..... 224/543
5,454,931 A 10/1995 Lauve
5,695,165 A * 12/1997 Moriarty ..... 248/316.8
5,979,846 A * 11/1999 Fluhr ..... 248/200
6,042,080 A * 3/2000 Shepherd et al. ..... 248/683
6,477,749 B1 * 11/2002 Reiter ..... 24/303
6,561,206 B1 * 5/2003 Wilkinson ..... 135/65
6,793,109 B2 9/2004 Gates et al.
6,793,184 B2 * 9/2004 Dougal et al. ..... 248/206.5

(Continued)

*Primary Examiner* — Todd M Epps
(74) *Attorney, Agent, or Firm* — Schroader & Siegfried, P.A.

(57) ABSTRACT

A magnetically mountable firearm or sporting instrument holding device of relatively small compass which is readily removable and portable, and can be utilized for providing a convenient place for hunters and sporting enthusiasts to rest their guns and sporting instruments upright on the outside of their car or other metal surface, and to protect that surface from scratches. The magnetic portable firearm or sporting instrument holding device generally includes a universal retaining member for supporting firearms and other sporting instruments having two opposite ends, the first end of which constitutes a recessed receiving end with inwardly tapered arms for guiding the instrument in place, and the second end comprising a common or multi-component magnetic mounting base. The mounting base may include a joining platform collar to orientate, mount, secure, and support the retaining member, and prevent twisting of the magnetic element of the mounting base. One or a plurality of such mounting bases, with or without platform collars, can be mounted to one or more retaining members.

20 Claims, 8 Drawing Sheets

(56) References Cited

U.S. PATENT DOCUMENTS

| | | | | |
|---|---|---|---|---|
| 6,951,289 | B2 * | 10/2005 | Scott, Jr. | 211/64 |
| 7,024,792 | B2 * | 4/2006 | Graham | 33/770 |
| 7,137,511 | B1 | 11/2006 | Croswell et al. | |
| D548,487 | S | 8/2007 | Osiecki et al. | |
| 7,377,474 | B2 * | 5/2008 | Curtis | 248/206.5 |
| 7,699,277 | B2 * | 4/2010 | Bagnall | 248/206.5 |
| 7,950,534 | B2 * | 5/2011 | Kao | 211/70.6 |
| 8,403,278 | B1 * | 3/2013 | Kasbohm | 248/206.5 |
| 2008/0087785 | A1 | 4/2008 | Roche | |
| 2009/0218741 | A1 * | 9/2009 | Winnard | 269/8 |
| 2011/0227735 | A1 * | 9/2011 | Fawcett et al. | 340/568.8 |

* cited by examiner

COMPACT PORTABLE FIREARM HOLDING DEVICE

CROSS REFERENCE TO RELATED APPLICATIONS

This application is a continuation of U.S. patent application Ser. No. 12/267,714, filed Nov. 10, 2008, which claims the benefit of U.S. Provisional Application Ser. No. 61/002,571, filed Nov. 9, 2007. The entire disclosures of each of the above applications are incorporated herein by reference.

BACKGROUND OF INVENTION

The present invention relates generally to holding devices for sporting instruments, and more specifically to a magnetic firearm or sporting instrument holding device of relatively small compass which is readily removable from its mounting surface and portable so as to provide an easily accessible and convenient place for hunters and sporting enthusiasts to rest their guns and sporting instruments. This magnetic holding device is designed and adapted to retain the gun or sporting instrument in an upright position on the outside of a car, or any other metal surface, and to protect that surface from being scratched.

It can be appreciated that gun holders of various constructions and holding devices for sporting instruments in general, have been in use for many years. Typically, gun holders are comprised of various stationary gun racks for mounting on walls, in safes, or inside vehicles. The main problem with conventional gun holders and stationary gun racks is that they are designed more for permanent storage of guns, and are not made to be removably mounted for convenient and easy portable access on the outside of vehicles and the like. Another problem with conventional gun holders is that they are not made small enough to fit in ones pocket so as to be quickly mounted and removed, thereby facilitating ease of portability. While these devices may be suitable for the particular purpose to which they address, they are not as suitable for providing a portable, removable, and convenient means of temporary storage for hunters and sporting enthusiasts to rest their guns and sporting instruments upright on the outside of their car or other metal surface; nor are they designed to protect that surface from scratches.

There are known gun holding devices which are capable of being mounted magnetically to the exterior of a vehicle. However, most of these devices are either too large to facilitate convenient portability, or are lacking in sufficient rigidity to maintain firm engagement with the surface to which they are mounted. In the later devices, the magnetic element is typically constructed of a flexible membrane which tends to twist and bend in conformance with the shape of the holding device, consequently reducing the surface area of magnetic attraction and weakening the connection.

Other know prior art devices do provide means for supporting a firearm in an upright position, but fail to adequately retain the firearm from becoming dislodged, thus creating an unsafe environment should the firearm be accidently bumped or jarred. Consequently, it is apparent that there is a distinct need in the industry for a magnetic firearm or sporting instrument holding device which is constructed of relatively small compass and readily removable from its mounting surface to facilitate ease of portability, which is designed to positively retain a firearm in a securely supported position, and which may optionally be designed with a more firm or rigid base element that prevents potential twisting or curling of the magnetic element and consequent unsafe dislodgement of the magnetic holding device form the surface to which it is mounted.

In this respect, the magnetic portable firearm or sporting instrument holding device described and claimed herein substantially departs from the conventional concepts and designs of the prior art, and in so doing, provides an apparatus developed for the purpose of meeting the above objectives, and for providing a portable, removable, and convenient temporary storage means which will allow hunters and sporting enthusiasts to rest their guns and sporting instruments in an upright position on the outside of their car, or any other metal surface, whilst at the same time protecting that surface from becoming scratched.

BRIEF SUMMARY OF THE INVENTION

In view of the foregoing disadvantages inherent in the known types of gun holders now present in the prior art, the present invention provides a uniquely constructed, novel magnetically mountable firearm or sporting instrument holding device of relatively small compass which is readily removable and portable, and can be utilized for providing a convenient place for hunters and sporting enthusiasts to rest their guns and sporting instruments upright on the outside of their car or other metal surface, and to protect that surface from scratches.

To attain this, the present invention comprises generally a magnetic holding device which includes a universal retaining member for securely supporting firearms and other sporting instruments to a metallic surface, such as the body of an automobile. In one preferred embodiment, the holding device has two opposite ends, with the first end having a gun or sporting instrument receiving cavity, and the second end being comprised a common or multi-component mounting base. In one such embodiment, the holding device may be composed of a rather firm, yet flexible and resilient retaining member to which a magnetized mounting base is secured by adhesive or otherwise.

In another embodiment, a relatively rigid joining platform collar may form a part of the mounting base and be positioned between the retaining member and a magnetic mounting element to provide a more rigid support or frame for the magnetic mounting element, and to orientate, mount, secure, and support the retaining member thereto. In this case, the retaining member and magnetic mounting element of the base may be secured to the joining platform collar via known adhesives or by other attachment means. It is contemplated that one or a plurality of such mounting bases, with or without platform collars, can be mounted to one or more retaining members.

One object of the magnetic firearm or sporting instrument holding device described and claimed herein is to provide such a device that is generally constructed of relatively small compass, is readily removable and portable, and provides a convenient place for hunters and sporting enthusiasts to rest their guns and sporting instruments upright on the outside of their car, or on any other metal surface, while at the same time protecting the mounting surface from becoming scratched.

Another object is to provide a magnetic portable firearm or sporting instrument holding device that has a pair of relatively flexible and resilient opposed arms with tapered leading edges that are biased toward one another to guide the barrel or object to be held into and between the biasly-opposed arms until it comes to rest and is firmly secured.

Still another object is to provide a magnetic portable firearm or sporting instrument holding device that actively and positively holds the gun or object in the orientation in which it is inserted so as to prevent undesirable turning or movement thereof.

It is another object of the present invention to provide a magnetic portable firearm or sporting instrument holding device that will hold items such as unloaded guns and other sporting instruments upright on the outside of a vehicle or other metal surface with the stock or base of the item resting on the ground.

Yet another object is to provide a magnetic portable firearm or sporting instrument holding device that is small enough to carry in a hunting or shooting vest, or jacket pocket, and is easily attached or removed from the mounting surface.

Another object of the present invention is to provide a magnetic portable firearm or sporting instrument holding device which is highly versatile and is capable of conforming to a variety of barrel sizes, gauges, and/or other gun configurations, with or without venting ribs.

Another object is to provide a magnetic portable firearm or sporting instrument holding device that provides a means for displaying visible indicia.

Still another object is to provide a magnetic portable firearm or sporting instrument holding device that protects the vehicle or other metal surface from scratches from the gun barrel or sporting instrument.

Other objects and advantages of the present invention will become apparent to the reader throughout the detailed discussion of the invention, and it is intended for these objects and advantages to be within the scope of the present invention. To the accomplishment of the above and related objects, the magnetic portable firearm or sporting instrument holding device described and claimed herein may be embodied in the form illustrated in the accompanying drawings, attention being called to the fact, however, that the drawings are illustrative only, and that changes may be made in the specific construction illustrated and described without departing from the scope of invention claimed herein. Also, it is to be understood that the phraseology and terminology employed herein are for the purpose of the description and should not be regarded as limiting.

BRIEF DESCRIPTION OF THE DRAWINGS

These and other objects and advantages of the invention will more fully appear from the following description, made in connection with the accompanying drawings, wherein like reference characters refer to the same or similar parts throughout the several views, and in which.

DETAILED DESCRIPTION OF THE INVENTION

Figure 1:
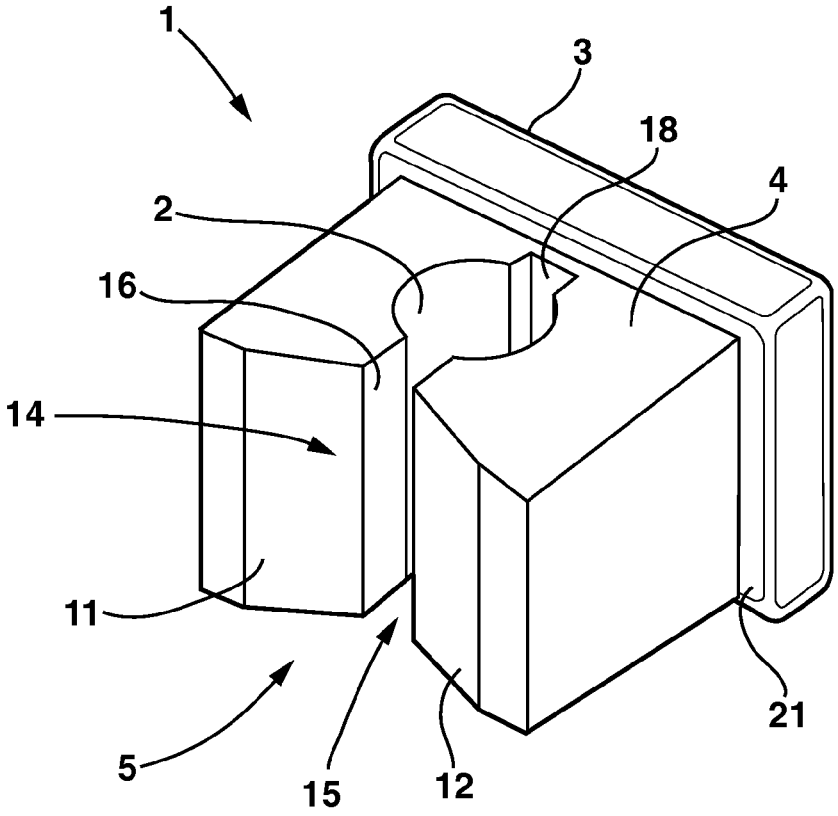
FIG. 1 is a perspective view of one preferred embodiment of a magnetic portable firearm or sporting instrument holding device embodying the principles of the present invention.

With reference being made to FIG. 1 of the drawings, a magnetic portable firearm or sporting instrument holding device 1 constructed in accordance with the present invention is disclosed. As shown, the holding device 1 defines an inlet on one end leading to a firearm and sporting instrument receiving cavity 2, with the opposite end comprising a common or multi-component magnetic mounting base 3. Although various alternative embodiments are contemplated, the magnetic holding device 1 in each includes a universal retaining member 4 which functions to retain and support the firearms and other sporting instruments with which the device is used. The retaining member 4 has two opposite ends, with the first constituting an instrument receiving end 5 designed to accept and hold various firearm barrel gauges/configurations and other sporting instruments, and the second forming a mounting surface 6 for connection to the common or multi-component magnetic mounting base 3. The magnetic mounting base 3 also has two ends, the first end 7 being connected to the mounting surface 6 of the retaining member 4 and the second end 8 providing a magnetized surface for mounting to the exterior of a vehicle or metal surface. Although the drawings illustrate only a single mounting base 3 connected to a single retaining member 4, it is contemplated that one or a plurality of such mounting bases 3 could be mounted to one or more retaining members 4 without departing from the invention herein.

Preferably, the retaining member 4 is constructed from a material that is firm, yet flexible and resilient. As such, it is contemplated that the retaining member 4 could be made from various materials such as plastic, wood, metal, rubber, foam, or extruded or molded magnetic material. In one preferred embodiment, the retaining member 4 is constructed of a foam rubber material, which exhibits the desired material characteristics described above. As shown in the drawings, the retaining member 4 is also preferably formed of a unitary monolithic construction, such that the particular features thereof are a continuous formation of the space within the foam rubber. However, it will be appreciated that the retaining member may be composed of a multi-component construction without departing from the invention herein.

As shown throughout the drawings, the retaining member 4 is preferably constructed to include a pair of relatively flexible and resilient opposed arms 9 and 10 with tapered leading edges 11 and 12 that are resiliently biased toward one another to help guide the gun barrel 13 (see, FIGS. 4-6) or other sporting instrument to be held thereby into the instrument receiving cavity 2 of the retaining member 4. As shown, the tapered leading edges 11 and 12 create a tapered recess or opening 14 leading to channel 15 between the flat pinching surfaces 16 and 17, and thereafter to the cylindrically-shaped instrument receiving cavity 2.

Figure 5:
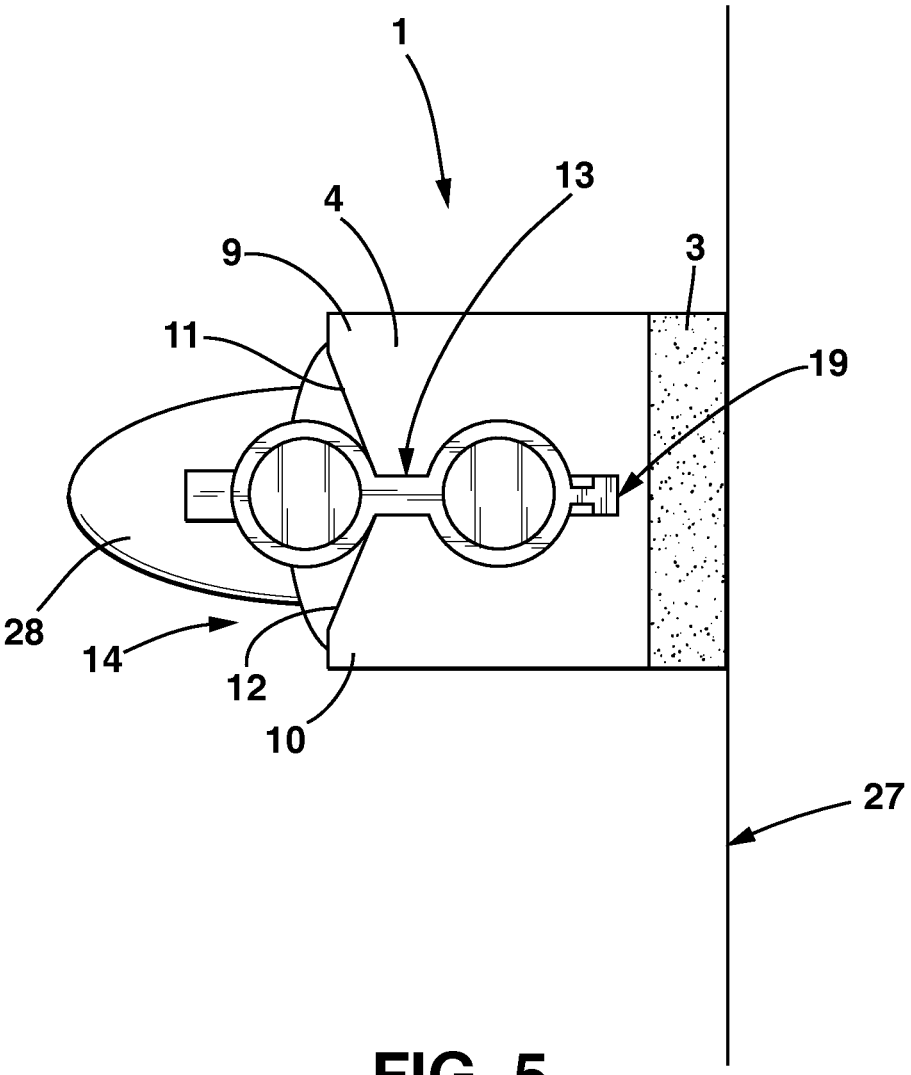
FIG. 5 is a top plan view of the magnetic portable firearm or sporting instrument holding device shown in FIG. 2, showing the device as used to secure an over-under double barrel gun.
Figure 6:
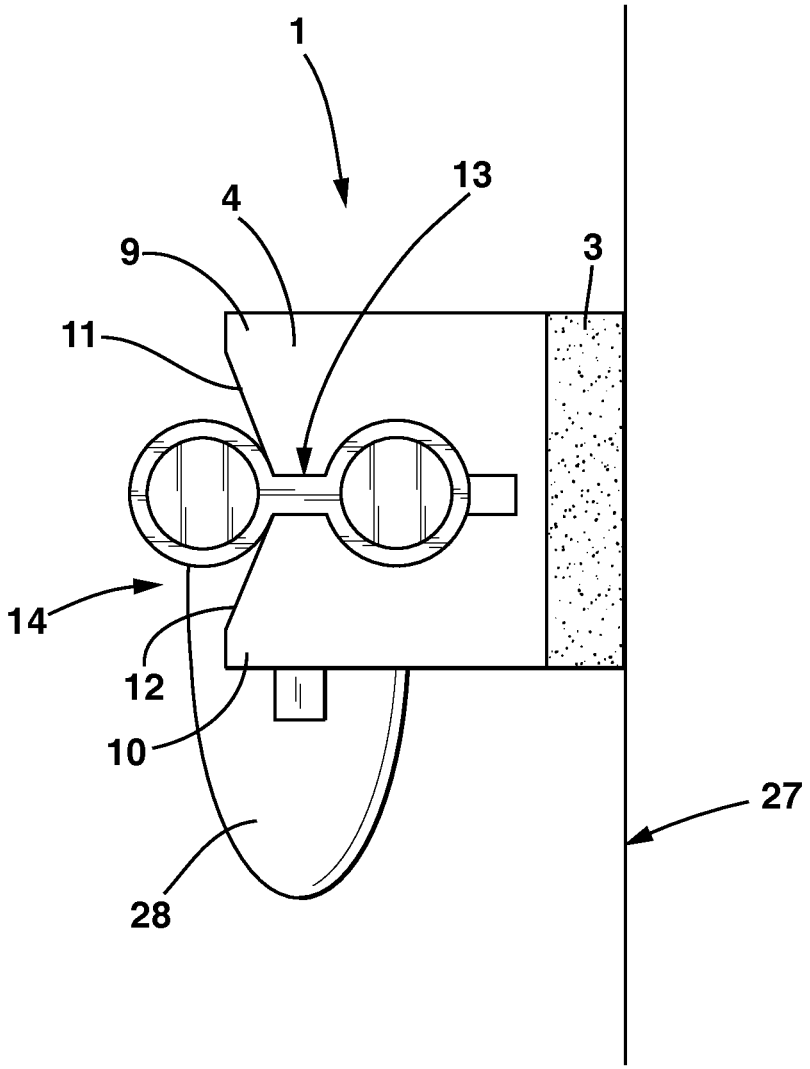
FIG. 6 is a top plan view of the magnetic portable firearm or sporting instrument holding device shown in FIG. 2, showing the device as used to secure a side-by-side double barrel gun.

As shown best in FIGS. 5 and 6, an extended recessed area 18 adjacent the mounting base 3 forms a space for gun barrels fitted with a venting rib 19 to seat. The open channel 15 between the pinching surfaces 16 and 17 of arms 9 and 10 essentially mirrors the shape of and extends parallel to the recessed area 18. It will be appreciated that the pinching surfaces 16 and 17 forming channel 15 not only function to retain a gun barrel within cavity 2, but as shown in FIGS. 5 and 6, also function to add additional support for double barrel gun configurations. As shown, the tapered leading edges 11 and 12 in combination with the pinching surfaces 16 and 17 of the retaining member 4 are cooperatively designed such that the retaining member 4 will support and retain both single and double barrel gun configurations.

It is contemplated that the retaining member 4 may be formed with appropriate shapes designed to specifically accommodate the various sizes or gauges of guns, such as 4-10, 20 and 12 gauge guns, and may have two cylinder areas for double barrel guns, rather than the shown rubber foam that is adapted to conform to the different sizes and configurations. The arms 9 and 10 of the retaining member 4 could also be made with different materials to create spring or tension loaded clamps or locking devices.

Figure 2:
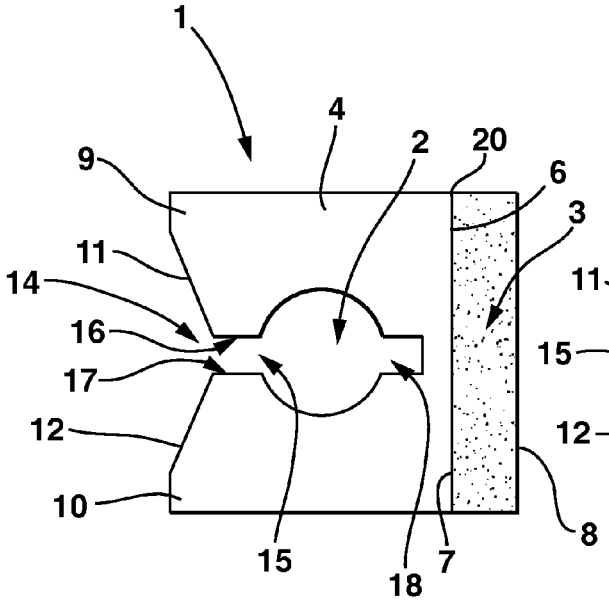
FIG. 2 is a top plan view of another embodiment of a magnetic portable firearm or sporting instrument holding device embodying the principles of the present invention.
Figure 3:
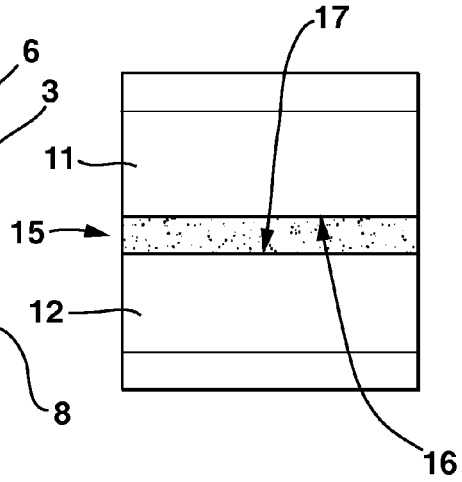
FIG. 3 is a front elevational view of the magnetic portable firearm or sporting instrument holding device shown in FIG. 2.

As noted previously, the opposite end 6 of retaining member 4 is configured to be adhered or otherwise secured to surface 7 of the mounting base 3. In one embodiment, as shown in FIG. 2, the mounting base 3 is comprised of a panel of magnetically charged material that is bonded directly to the retaining member 4 by an adhesive layer 20 or other connective means. In this form, the bottom side 8 of the mounting base 3 would be flat and have a rubber or other relatively non-abrasive material coating if the magnetically charged material was constructed of something other than a flexible rubber magnet.

Various magnetic materials could be used, such as ceramic, Neodymium, or Alnico and extruded flexible material. However, any material utilized other than a soft flexible magnetic material should be coated with a relatively non-abrasive material such as rubber to prevent scratching of the metallic surface to which it is mounted. Optionally, the magnet could be recessed into the retaining member 4 enough so that the magnet is not in direct contact with the metal surface.

The base 3 could also be comprised of other connection means such as suction cups which, similar to magnets, function as a pressure release connecting element that is easily connected and readily releasable from its mounting surface through the mere application of tensional force. Consequently, the base 3 is designed to facilitate easy removability and portability of the holding device 1, thereby permitting temporary and convenient access and storage of firearms and sporting instruments.

As noted previously, to further enhance the portability and convenience of the holding device 1, the base 3 and retaining member 4, as a unit, is preferably constructed of relatively small compass for easy storage and transport within the pocket of a hunting jacket or the like. This has particular relevance in hunting and military applications, where firearms are routinely transported from place to place on a daily basis, and safety and maintenance of firearm cleanliness is of the utmost importance.

As shown best in FIG. 1, in one preferred embodiment, the holding device 1 is configured to be generally pocket-sized, such that the outer confines of the device 1 closely surround a single main receiving cavity 2 adapted to support the barrel of a firearm or other sporting instrument. As shown, the base 3 and retaining member 4, together as a unit, may be generally cube-shaped or otherwise configured compactly for purposes of stability. In one preferred embodiment, as shown, the maximum diametrical dimensions of the retaining member 4 and base 3, together as a unit, do not substantially exceed approximately four times the transverse dimension of the receiving cavity 2 between the opposing legs 9 and 10 of retainer 4. As such, given the extremely compact nature of the holding device 1, the device may be easily removed, transported and remounted on any suitable mounting surface with relative ease.

Figures 8, 9:
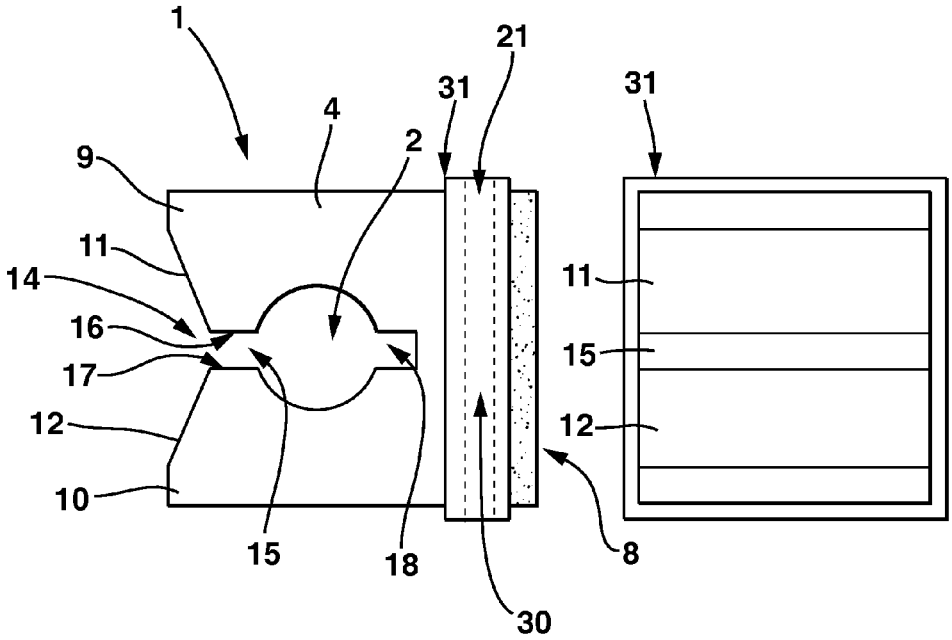
FIG. 8 is a top plan view of the magnetic portable firearm or sporting instrument holding device shown in FIG. 1, showing the construction of the device with a surrounding rigid platform collar at the mounting base.
FIG. 9 is a front elevational view of the magnetic portable firearm or sporting instrument holding device shown in FIGS. 1 and 8.
Figure 10:
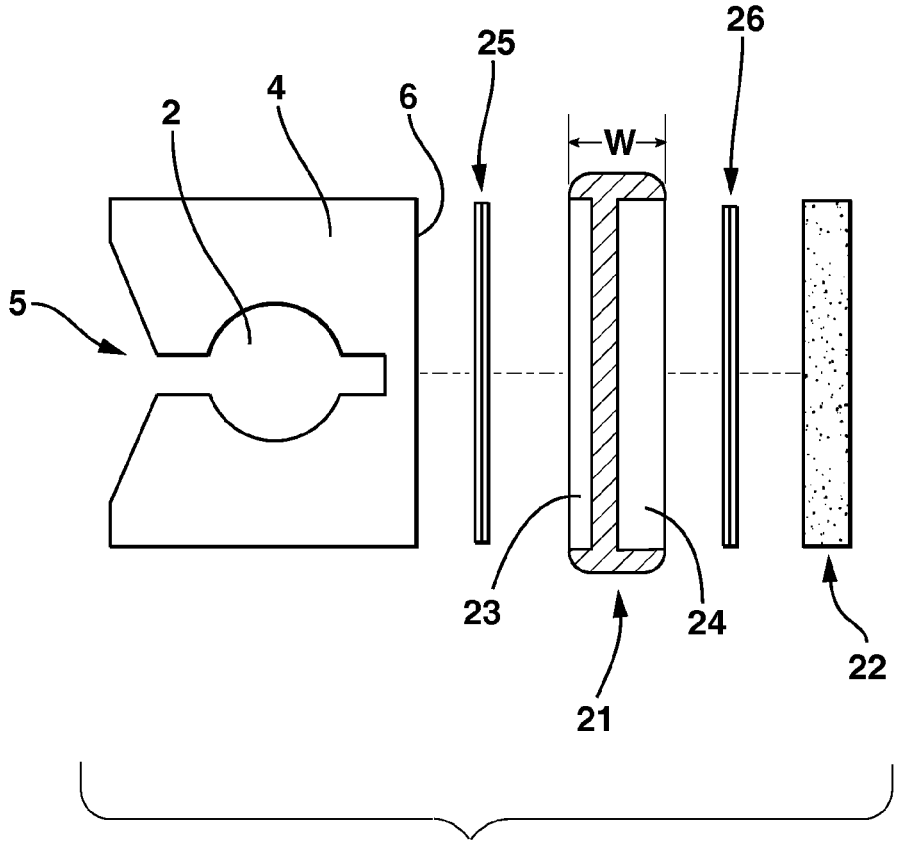
FIG. 10 is an exploded top plan view of the magnetic portable firearm or sporting instrument holding device shown in FIGS. 1 and 8, showing one manner of constructing the same.

As shown in FIGS. 8-10, in an alternative preferred embodiment, the mounting base 3 of the holding device 1 incorporates a relatively rigid joining platform collar 21 which is positioned between the retaining member 4 and a magnetic mounting element 22 to provide a more rigid support or frame for the magnetic mounting element 22, and to orientate, mount, secure, and support the retaining member 4 thereto. As shown, the collar 21 is constructed with opposing recessed areas 23 and 24. Recess 23 is designed to receive and carry retaining member 4. An adhesive layer 25 or other securing means can be used to affix the retaining member 4 within recess 23.

Similarly, the opposing recess 24 of collar 21 is designed to carry the magnetic mounting element 22, and an adhesive layer 26 or other securing means may be utilized to retain the magnetic mounting element 22 in place. In the embodiment shown, the collar 21 is constructed to extend outwardly from and around the retaining member 4 and magnetic mounting element 22, thereby forming a platform shoulder of width "W" that is suitable for printing desired indicia, such as instructions, product warnings and/or trademarks, etc. Here again, it is contemplated that one or a plurality of such mounting bases 3, with or without platform collars 21, can be mounted to one or more retaining members 4. The collar 21 could also have a textured surface 30 and/or extended edges 31 for gripping the device when applying to or pulling off a surface. The platform collar 21 would preferably be molded of a plastic material, or other relatively rigid materials, such as wood or metal. Other high strength adhesives or mechanical couplings, such as rivets, could be used to connect the retaining member 4 to the mounting base 3.

Figure 7:
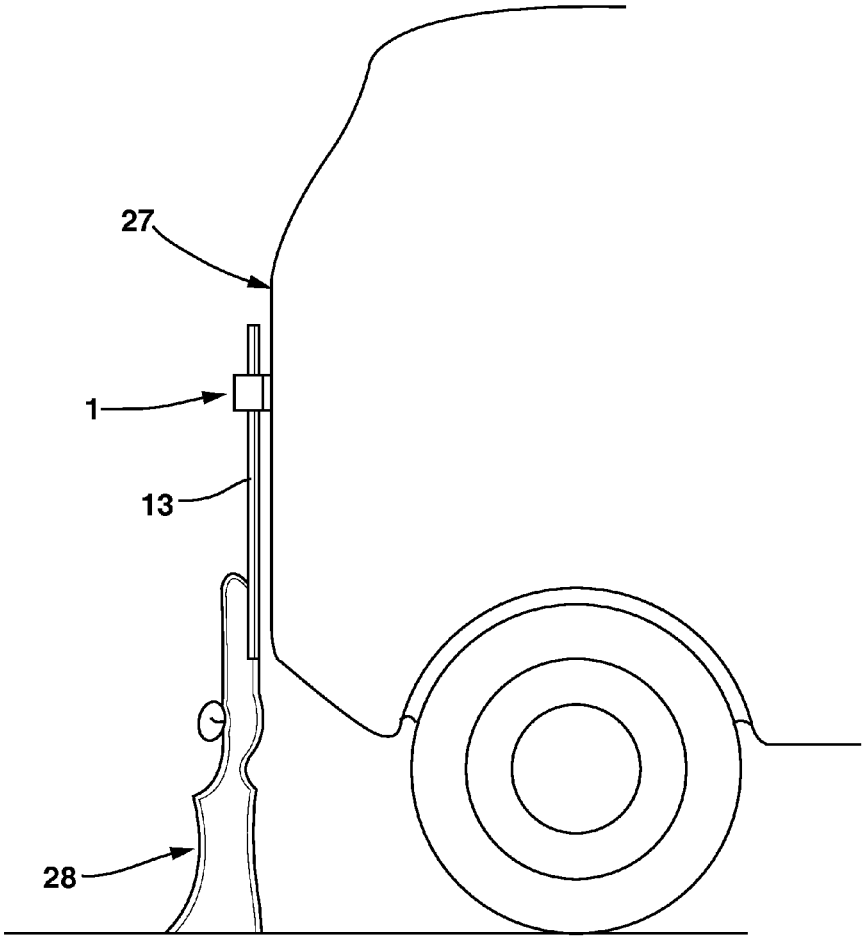
FIG. 7 is a side view of a magnetic portable firearm or sporting instrument holding device embodying the principles of the present invention and being shown in use to secure a firearm in an upright position against the rear of a vehicle.

As shown in FIG. 7, the user of the holding device 1 places its magnetic mounting base 3 in contact with the outside of the vehicle 27, or other metal surface, with the instrument receiving cavity 2 of the retaining member 4 vertically oriented and positioned at the optimum height to support the desired firearm 28 or other sporting instrument. As shown in FIG. 7, the gun barrel or sporting instrument is then placed in contact with the receiving end 5 of the retaining member 4, such that the gun barrel or body of the sporting instrument engages the recessed area 14 formed by the tapered leading edges 11 and 12 thereof. As further shown, it is desirable that the stock of the gun or base of the sporting instrument be resting on the ground.

Figure 4:
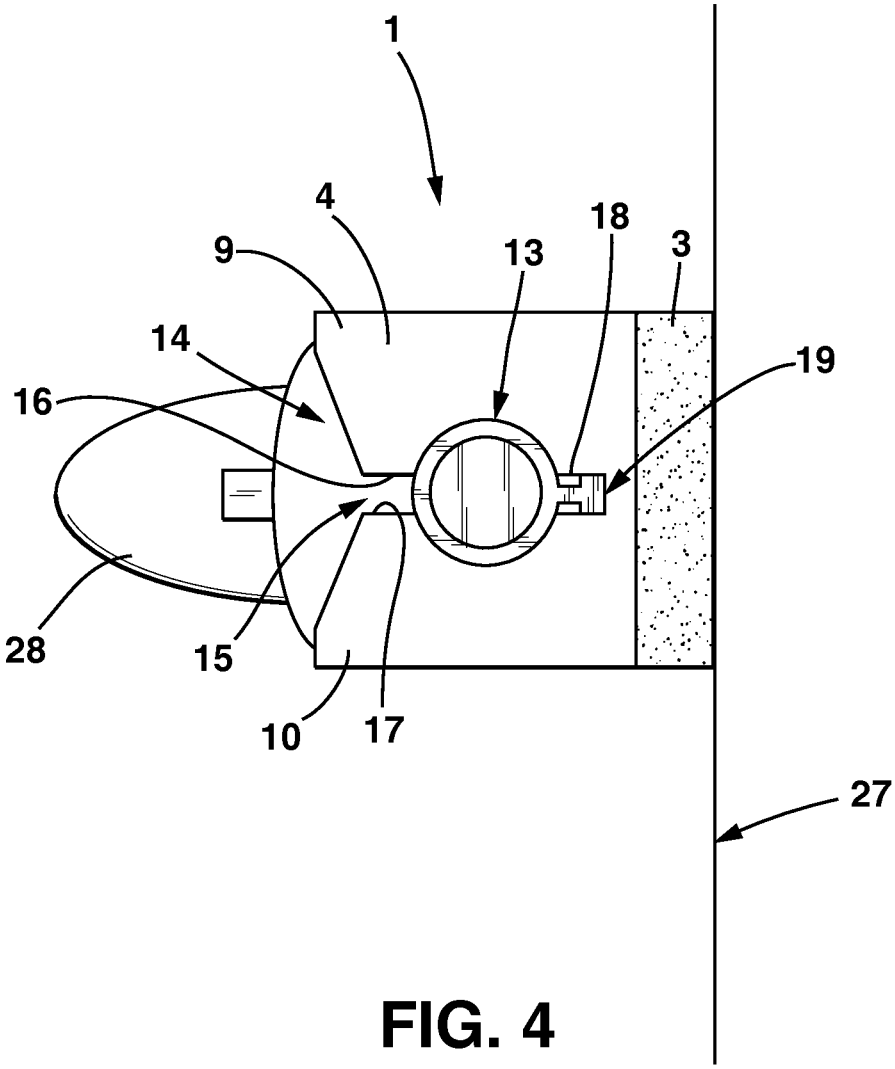
FIG. 4 is a top plan view of the magnetic portable firearm or sporting instrument holding device shown in FIG. 2, showing the device as used to secure a single barrel gun.

By way of example, with specific reference to FIGS. 4, 5 and 6, it can be seen that when using the holding device 1 with a firearm 28, the barrel 13 of the gun will engage the tapered leading edges 11 and 12 of the resilient arms 9 and 10, such that upon application of a relatively light force against the barrel 13, the barrel will force the resiliently biased arms 9 and 10 of the retaining member 4 outward, allowing the barrel 13 to pass through channel 15 and come to rest in the cylindrical receiving cavity 2. If the gun barrel has a venting rib 19, as shown in FIGS. 4 and 5, the recessed area 18 closest to the mounting base 3 forms a space to accommodate such a rib. The recessed area 18 also aids in holding the gun 28 perpendicular to the mounting surface 27, and keeps it from twisting. Once the barrel 13 is at rest in the receiving cavity 2, the resilient arms 9 and 10 flex back around the barrel to hold the barrel in place.

As illustrated, the overall shape and material of the retaining member 4 with tapered leading edges 11 and 12, and cavity 2, is designed such that all types of barrel configurations can be held. A single barrel with or without a venting rib is shown in FIG. 4. An over-under double barrel shown in FIG. 5. A side-by-side double barrel is shown in FIG. 6. The side-by-side configuration is accommodated by turning the gun 90 degrees. In the case of the double barrel configurations, as shown in FIGS. 5 and 6, the tapered recessed area 14 in combination with receiving cavity 2 and pinching surfaces 16 and 17, are specifically designed to accommodate and conform to the shape of the barrel 13. In such case the pinching surfaces 16 and 17, as well as the recessed area 18 when a barrel is equipped with a venting rib 19, add additional holding support and help keep the gun 28 from twisting, which helps the gun rest in a more stable manner.

With the above detailed description having been made, the following exemplary embodiments are hereafter described to further the readers understanding of the scope of the present invention. First, it is contemplated that the holding device may include a magnetized retaining member adapted to temporarily receive one of a portion of a firearm and/or a sporting instrument, wherein the base of such retaining member includes a magnetic material and a relatively non-abrasive material is disposed over at least a portion of the base. The magnetic material could be disposed in a recessed or receiving portion of the base. Portions of the base may also be composed of dissimilar shapes or materials.

By further example, the base may be comprised of a multi-component construction. A magnetically chargeable material may couple to the base or may fit within a receiving portion thereof. The retaining member should provide a biasing force within the firearm or sporting instrument receiving area to retain the item in place. The holding device may further include indicia disposed on a portion of the mounting base. The indicia may include colors, patterns, lettering, symbols, numbers, trademarks, trade names, logos, reflective means, instructions, warnings, etc.

The magnetically chargeable material may be in the form of a sheet, panel or other layer or coating of material. It should have some means of attachment to the mounting base, whether that is by adhesive or other suitable attachment, such as a mechanical coupling element.

In another example, the mounting base may include a rigid collar member. The collar member may be of a unitary construction, such as a molded plastic member. It could also be comprised of a continuous belt, a cup-shaped member, a disk, a hollow disk, or other rigid or semi-rigid mechanical member capable of being magnetized or holding a magnetic material, as described above. In the later case, the collar should have means for attaching or carrying the magnetically charged material, whether that is by adhesive or other securing means. It is contemplated that the collar could have a set of engageable locking tabs that would engage and hold a magnetic panel or sheet of material in place within a recessed portion of the base.

The present invention also contemplates a method of fabricating a magnetized portable gun or sporting instrument holding device comprising the steps of providing a retaining member with a base that includes a magnetized material, wherein the holding device is adapted to temporarily receive one of a portion of a firearm and/or other sporting instrument, and applying a relatively non-abrasive material to at least a portion of the magnetized base. As above, the magnetic material could be disposed in a recessed or receiving portion of the base. Portions of the base may also be composed of dissimilar shapes or materials.

A method of fabrication is also contemplated wherein the base provided may be of a multi-component construction, and the method may include the step of coupling a magnetically chargeable material to the base or fitting the same within a receiving portion of the base. Again, the retaining member provided should be constructed to present a biasing force within the firearm or sporting instrument receiving area to retain the item in place. The method may also include the step of applying indicia as described previously to a portion of the mounting base of the holding device.

The step of coupling a magnetically chargeable material to the base of the holding device may include attachment of a magnetized sheet, panel or other layer, or the application of a magnetized coating of material. The step of attaching such a magnetized material to the mounting base may include the application of an adhesive, double-sided adhesive tape, or the use of other suitable attachment means, such as a mechanical coupling element.

In another exemplary method of fabricating such a magnetic portable holding device, the mounting base provided may include a rigid collar member, as described above. The collar member may be of a unitary construction, such as a molded plastic member. It could also be comprised of a continuous belt, a cup-shaped member, a disk, a hollow disk, or other rigid or semi-rigid mechanical member capable of being magnetized or holding a magnetic material, as described above. In the later case, the collar should have means for attaching or carrying the magnetically charged material, whether that is by adhesive or other securing means. An adhesive could be applied to the collar member, and the magnetic material affixed thereto. It is also contemplated that the collar could have a set of engageable locking tabs that would engage and hold a magnetic panel or sheet of material in place within a recessed portion of the base. The retaining member of the holding device would also be attached to the collar member by means of applying an adhesive or other suitable securing means.

In the methods as described above, it is further contemplated that the base member may be fabricated by such techniques as injection molding, extrusion, milling, etc. The method may further comprise the step of coupling a source of energy to the base, where the source of energy comprises one or more of a primary battery, a secondary battery, a photovoltaic cell, and a spring. The method may further include the step of providing a signaling device coupled to the source of energy, wherein the signaling device comprises one or more of a source of light, an audible signal, a visible signal, and/or a tactile signal. The signaling device may be disposed remotely from the base and be wirelessly coupled thereto, or it may be coupled directly to the base.

In the methods described above, it is also contemplated that the holding device may in whole or part be constructed of a porous material. Further steps may include applying a substance to the porous material, such as a surfactant, a lubricating material, a fragrance, and/or an abrasive material.

In a further example, a method of fabricating a magnetized holding device is contemplated wherein the holding device includes a magnetizable material and is adapted to temporarily receive one of a portion of a firearm and a sporting instrument, and a relatively non-abrasive material is applied to a base portion of the holding device. The magnetizing material may be incorporated into the body of the holding device, or may be disposed in a receiving portion of the base portion thereof. The main body and base portion of the holding device may take on dissimilar shapes and may be constructed of dissimilar materials.

In this method of fabrication, the base may be integral with the main body portion or may be comprised of multiple parts. The magnetizable material may be coupled directly to the holding device, to the base or to a receiving portion of the base. The magnatizable material may comprise a sheet, panel or other layer of material, and the method may further include the step of providing a means of attachment such as an adhesive material or mechanical coupling disposed between the sheet and the base. The holding device should be fabricated such that it provides a biasing force within the receiving portion, and visible indicia as described above may also be disposed on a portion of the holding device, including the base.

As in previous embodiments, the holding device may be fabricated with a collar member formed as a part of the base thereof. The collar member may be comprised of a unitary plastic member, or a continuous belt, a cup-shaped member, a disk, a hollow disk, or other mechanical member. The collar member may carry the magnetizable material, and the fabrication method may include the step of attaching the magnetizable material to the collar with an adhesive of other securing means. The main body of the holding device may also be attached to the collar member in like manner.

Using this method of manufacture, the components of the holding device, including the collar, may be fabricated by any one of a number of methods, including injection molding, extrusion, milling, etc. The method may further include the step of coupling a source of energy to the holding device, such as a primary battery, a secondary battery, a photovoltaic cell or a spring. Also, the method could include coupling a signaling device to the source of energy, such as a source of light, an audible signal, a visible signal or a tactile signal. The signaling device may be coupled remotely for wireless operation or directly to the holding device. As in previous embodiments, the holding device, or a portion thereof, may be comprised of a porous material, and may be coated with an outer substance, such as a surfactant, a lubricating material, a fragrance and/or an abrasive material.

It will, of course, be understood that various changes may be made in the form, details, arrangement and proportions of the parts without departing from the scope of the invention which comprises the matter shown and described herein and set forth in the appended claims.

The invention claimed is:

1. A compact portable firearm holding device for supporting a firearm against a mounting surface, comprising:

(a) a retaining member formed of a flexible material and having a firearm receiving cavity formed therein;

(b) a base member formed of a material more rigid than said retaining member;

(c) a first surface of said base member including a pressure release connecting member constructed to releasably secure said base member to the mounting surface;

(d) a second surface of said base member being connected in supporting relation to said retaining member; and (e) said retaining member and said base member together forming a pocket-size unit having defined outer confines which closely surround said firearm receiving cavity.

2. The compact portable firearm holding device of claim 1, wherein said base member includes recessed portions for carrying said connecting member and said retaining member.

3. The compact portable firearm holding device of claim 1, wherein said retaining member is stationary relative to said base member.

4. The compact portable firearm holding device of claim 1, wherein said retaining member is formed throughout of a continuous block of flexible, resilient foam-like material.

5. The compact portable firearm holding device of claim 1, wherein said retaining member is comprised a pair of opposed extended arms forming a substantially closed elongated channel therebetween which defines said firearm receiving cavity.

6. The compact portable firearm holding device of claim 1, wherein a base member has a multi-component construction being comprised of a collar member and said magnetizable material.

7. The compact portable firearm holding device of claim 1, wherein said pressure release connecting member includes a magnetizable material.

8. The compact portable firearm holding device of claim 7, wherein said magnetizeable material is comprised of Neodymium.

9. The compact portable firearm holding device of claim 1, wherein said base member includes an extended edge portion for gripping the holding device.

10. The compact portable firearm holding device of claim 1, wherein at least a portion of an outer peripheral surface of said base member is textured to aid in gripping the holding.

11. The compact portable firearm holding device of claim 1, including a clamping member for locking the firearm within said retaining member.

12. A compact portable firearm holding device for supporting a firearm against a mounting surface, comprising:

(a) a retaining member formed throughout of a continuous block of flexible, resilient foam-like material, said retaining member having a single firearm receiving cavity formed therein;

(b) a base member formed of a relatively inflexible, rigid material;

(c) a first surface of said base member carrying a pressure release connecting member comprised of a magnetic material for releasably securing said base member to the mounting surface;

(d) a second surface of said base member being connected in supporting relation to said retaining member; and (e) said retaining member and said base member together forming a generally cube-shaped pocket-size unit having defined outer confines which closely surround said firearm receiving cavity.

13. The compact portable firearm holding device of claim 12, wherein said base member includes recessed portions for carrying said connecting member and said retaining member.

14. The compact portable firearm holding device of claim 12, wherein said retaining member is comprised a pair of opposed extended arms forming a substantially closed elongated channel therebetween which defines said firearm receiving cavity.

15. The compact portable firearm holding device of claim 14, wherein a maximum diametrical dimension of said pocket-size unit does not substantially exceed approximately four times a transverse dimension of said firearm receiving cavity extending between said opposed arms.

16. The compact portable firearm holding device of claim 12, wherein said magnetic material is coated with a non-abrasive rubber material.

17. The compact portable firearm holding device of claim 16, wherein said base member includes an electronic signaling means connected thereto for emitting an alert signal.

18. The compact portable firearm holding device of claim 12, wherein said base member includes at least one gripping member selected from a group consisting of an extended edge portion and a textured gripping portion.

19. A compact portable firearm holding device for supporting a firearm against a mounting surface, comprising:

(a) a retaining member formed of a flexible material and having a firearm receiving cavity formed therein;

(b) a base member formed of a material more rigid than said retaining member;

(c) a first surface of said base member including a pressure release connecting member constructed to releasably secure said base member to the mounting surface;

(d) a second surface of said base member being connected in supporting relation to said retaining member; and (e) said first surface of said base member including a recessed portion for carrying said connecting member and said second surface of said base member including a recessed portion for carrying said retaining member, said retaining member and said base member together forming a pocket-size unit formed of relatively small compass for ease of portability.

20. The compact portable firearm holding device of claim 19, wherein said base member includes at least one gripping member selected from a group consisting of an extended edge portion and a textured gripping portion.

* * * * *